United States Patent [19]

Ruth

[11] Patent Number: 4,914,754

[45] Date of Patent: Apr. 10, 1990

[54] DISPOSABLE CAP AND CAPE FOR CHEMICAL PROCESSING OF HAIR

[76] Inventor: Michael Ruth, 12130 Ventura Blvd., Studio City, Calif. 91604

[21] Appl. No.: 243,461

[22] Filed: Sep. 12, 1988

[51] Int. Cl.[4] ..... A41D 23/00; A41D 27/00

[52] U.S. Cl. ..... 2/174; 2/171; 2/207; 2/243 B

[58] Field of Search ..... 2/174, 207, 243 B, 171, 2/172, 202, 206

[56] References Cited

U.S. PATENT DOCUMENTS

| | | | |
|---|---|---|---|
| 1,056,433 | 3/1913 | McDermott | 2/207 |
| 1,909,686 | 5/1933 | Kindell | 2/172 |
| 1,999,252 | 4/1935 | Mullendore | 2/171 |
| 2,205,972 | 6/1940 | Davis | 2/174 X |
| 2,296,078 | 9/1942 | Young | 2/174 |
| 2,446,122 | 7/1948 | Bills | 2/174 |
| 2,519,512 | 8/1950 | Stone | 2/172 |
| 2,629,869 | 3/1953 | Locken | 2/174 X |
| 2,686,917 | 8/1954 | Auerbach | 2/172 |
| 2,706,861 | 4/1955 | Schmeer | 2/171 X |
| 2,709,442 | 5/1955 | Willat | 2/174 X |
| 2,769,980 | 11/1956 | Fleischer | 2/174 |
| 2,804,626 | 9/1957 | Rossiter | 2/207 |
| 3,235,882 | 2/1966 | Coleman | 2/174 |
| 3,480,970 | 12/1969 | Gettinger | 2/171 X |
| 4,133,052 | 1/1979 | Hodgman et al. | 2/174 |
| 4,457,026 | 7/1984 | Morris | 2/171 |
| 4,605,017 | 8/1986 | Thompson et al. | 2/174 X |

FOREIGN PATENT DOCUMENTS

| | | | |
|---|---|---|---|
| 1949976 | 4/1971 | Fed. Rep. of Germany | 2/174 |

*Primary Examiner*—Werner H. Schroeder
*Assistant Examiner*—Jeanette E. Chapman
*Attorney, Agent, or Firm*—Timothy T. Tyson

[57] ABSTRACT

A disposable cap and cape is provided for use during the chemical processing of hair both during the waiting period and the rinsing phase. It is preferrably fabricated from a single rectangular sheet of thin flexible plastic. The cap portion is formed at one end by folding the sheet over onto itself and welding the sides to each. A U-shaped neck cutout is made at the other end creating ties from the remaining material on either side. When the device is used as a cap, the cap portion is fitted over the head and the chemical is retained inside by the proximity of the sheet material. When the device is used as a cape, one tie is positioned on each side of the head, the device is pulled up to the back of the neck, the ties are tied together at the forehead, and the cap portion is allowed to drape down the back. Rinse water and chemicals then flow over the outside of the former cap into a sink.

12 Claims, 2 Drawing Sheets

DISPOSABLE CAP AND CAPE FOR CHEMICAL PROCESSING OF HAIR

TECHNICAL FIELD

The present invention pertains to the apparel art, and more particularly, to a disposable cap and cape for use during the chemical processing of hair including permanent waving and coloring.

BACKGROUND ART

The chemical processing of hair requires several steps: cleaning prior to any treatment, cutting or rolling, application of the chemical, waiting to allow the chemical process to take place, application of a neutralizer for the chemical if necessary, waiting for the neutralizer process to take place, and rinsing with water to remove any remaining neutralizer or chemical. The whole process is uncomfortable for the recipient because the liquids tend to run over the body, many are caustic, and many are smelly.

Several devices have been developed for use during the chemical processing of hair. The most common in current use is a thin plastic cap which is placed over the hair after the application of the chemicals. It helps to keep the chemicals on the hair during the time necessary for the process to take place. Other hair covering devices are shown in U.S. Pat. Nos. 1,516,796; 2,600,557; and 3,064,267. Rinsing capes for covering the neck, shoulders, and back are shown in U.S. Pat. Nos. 2,729,823 and 4,133,052. None of these patents show devices which may be used both to cover the hair during the waiting period and the neck, shoulders, and back during the rinsing phase.

DISCLOSURE OF INVENTION

The present invention is directed to a disposable cap and cape for use during the chemical processing of hair both during the waiting period and the rinsing phase. It is fabricated of flexible sheet material such as thin plastic. In a preferred embodiment, the entire cap and cape is made from a single sheet of material by folding, cutting, and welding (or other form of coupling the sheets together). However, it may also be made from three individual sheets. The first and second sheets are coupled to each other along the sides and one end to form a hat portion. The third sheet is cut from one end toward the other to provide a place for the neck and to create ties between the cut and the sides. The uncut end of the third sheet may be attached to the first sheet at either end. When the device is used as a cap, the cap portion is fitted over the head and the chemical is retained inside by the proximity of the sheet material. When the device is used as a cape, one tie is positioned on each side of the head, the device is pulled up to the back of the neck, the ties are tied together at the forehead, and the cap portion is allowed to drape down the back. The water then flows over the outside of the former cap into the sink.

In accordance with one important aspect of the invention, the third sheet is coupled to the first sheet along the first or open end of the hat portion. This allows the liquid to flow down the entire length of the device during the rinsing phase if the opening is placed on the bottom or, alternatively, into the interior of the hat portion if the opening is placed on the top side.

In accordance with another important aspect of the invention, the cut in the third sheet is substantially U-shaped forming a U-shaped neck opening between the ties. The U-shape cut is better contoured to seal against the base of the neck than is a single slit type of cut and also makes the ties thinner and more maneuverable.

As noted above, in the preferred embodiment the entire device is fabricated from a single continuous sheet of material. This considerably simplifies the manufacture because the elements are already in the correct relationship to each other. Also, no seams are present which might leak liquid through the device.

MODES FOR CARRYING OUT THE INVENTION

Figure 1:
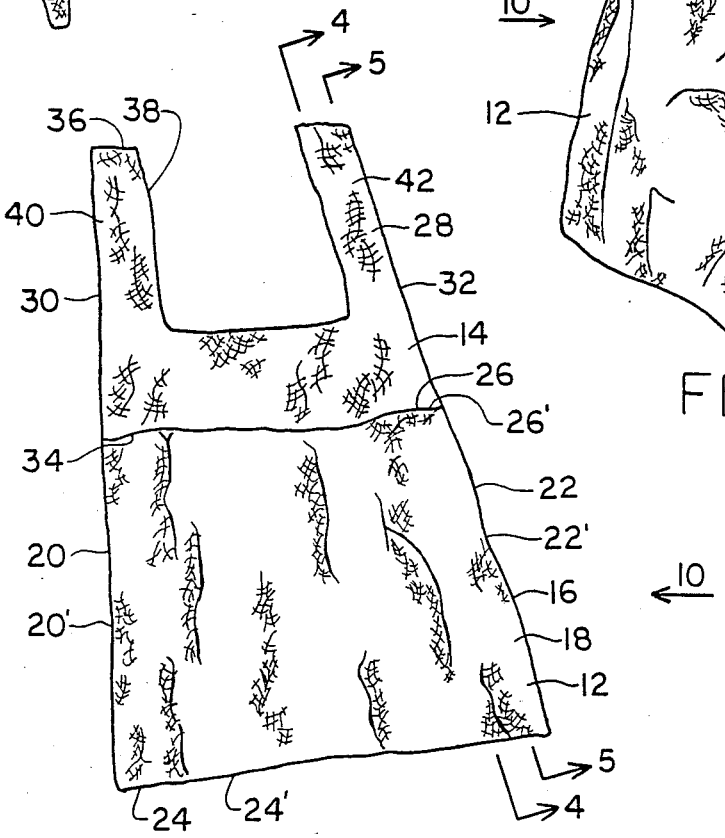
FIG. 1 is a perspective view of a disposable cap and cape in accordance with the present invention.

Referring initially to FIG. 1, there is illustrated a perspective view of a disposable cap and cape, generally designated 10, of the present invention, in a substantially flat form prior to use. The cap and cape are preferably fabricated of a thin flexible plastic material similar to that used in disposable shopping bags. Information, advertisements, trademarks, designs, or other material may be printed on the outside if desired in the same manner as found on plastic shopping bags. The cap and cape 10 has two major portions: the cap portion 12 and the cape portion 14. The cap portion is fabricated by either folding one rectangular sheet over on itself or from two rectangular flexible sheets coupled together. In the preferred embodiment, the entire cap and cape 10 is fabricated from one rectangular sheet by folding, cutting, and laminating at the appropriate locations as partially shown in FIGS. 4 and 5.

Figure 7:
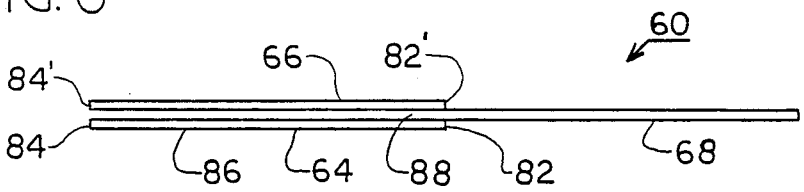
FIG. 7 is a side sectional view along the line 7—7 of FIG. 6.

In FIG. 1, a first flexible sheet or portion 16 is located exactly under a second flexible sheet or portion 18. Each has a first side 20, 20', a second side 22, 22', a first end 24, 24', and a second end 26, 26'. Similarly a third flexible sheet or portion 28 has first and second sides 30 and 32 and first and second ends 34 and 36. A cut 38 between the sides extends from the second end 36 toward the first end 34 and defines a first tie 40 between the first side and the cut and a second tie 42 between the cut and the second side. In the preferred embodiment, the cut 38 is substantially U-shaped as shown in FIG. 1 forming a U-shaped neck opening between the first and second ties. The first sides 20, 20', the second sides 22, 22', and the first ends 24, 24' of the first and second sheets are coupled together preferably by welding or laminating using heat. The first end 34 of the third sheet 28 is coupled to the second end 26 of the first sheet 16 also preferably by welding or laminating using heat, Alternatively and preferably, the first and second sheets 16 and 18 are coupled together at the first ends 24, 24' by being fabricated from one sheet which is folded onto itself. Similarly, the first and third sheets 16 and 28 are coupled together at their second and first ends 26 and 34, respectively, by being fabricated from one sheet. The single sheet structure is show in FIG. 4 while the multiple sheet structure is shown in FIG. 7.

Figure 2:
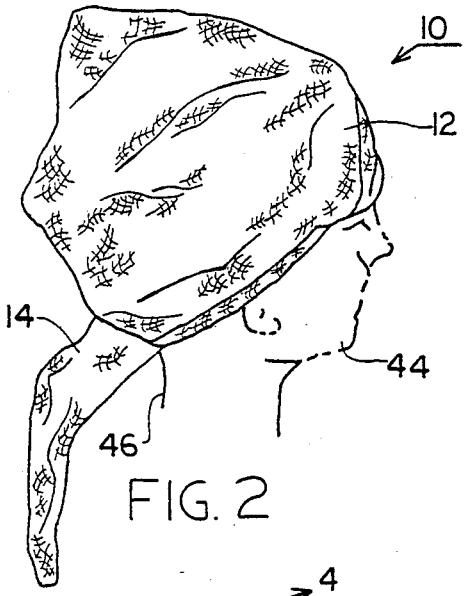
FIG. 2 is a rear perspective view of the device in the cap mode installed on a person's head.

FIG. 2 is a rear perspective view of the cap and cape 10 in the cap mode installed on a person's head 44. The hair is tucked entirely inside the cap portion 12 allowing the cape portion 14 to fall down the back of the neck 46 The cap portion helps to keep the chemicals from evaporating also retains heat inside to speed the chemical process.

Figure 3:
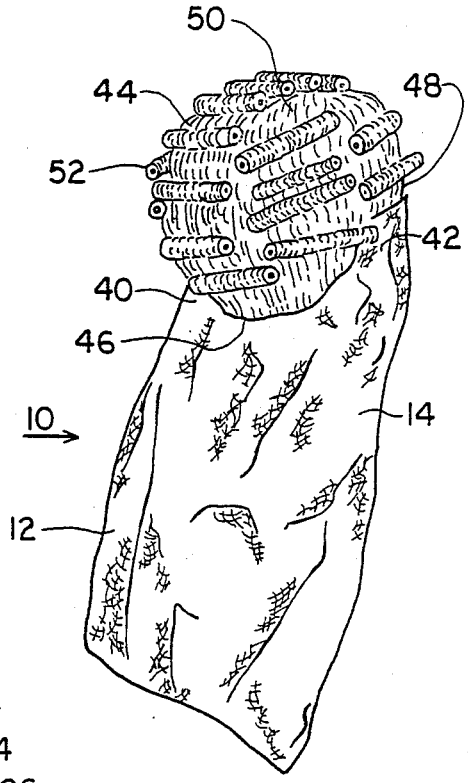
FIG. 3 is a rear perspective view of the device in the cape mode installed around a person's head.

FIG. 3 is a rear perspective view of the cap and cape 10 in the cape mode installed around a person's head 44. One tie 40 is positioned on the left side of the head and the other tie 42 is positioned on the right side. The cape portion 14 is pulled up to the back of the neck 46 and the ties are tied together at the forehead 48. The cap portion 12 is allowed to drape down the back. The U-shaped cut 38 shown in FIG. 1 allows the cap to conform to the shape of the neck. The hair 50, processing appliances such as curlers 52, and chemicals on the hair are now exposed for rinsing. Chemicals and water used for rinsing now fall down the cape portion 14 over the cap portion 12 and into a sink without wetting the neck and shoulders of the person receiving the hair treatment.

Figure 4:
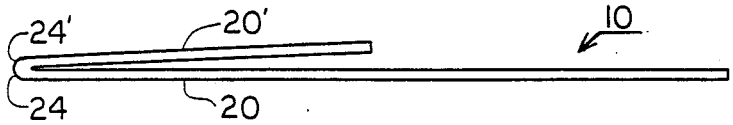
FIG. 4 is a side sectional view along the line 4—4 of FIG. 1.

FIG. 4 is a side sectional view along the line 4—4 of FIG. 1. The cap and cape 10 can now clearly be seen to be fabricated from one sheet of flexible material by being folded at the first ends 24, 24' of the first and second sheet portions 20, 20'.

Figure 5:
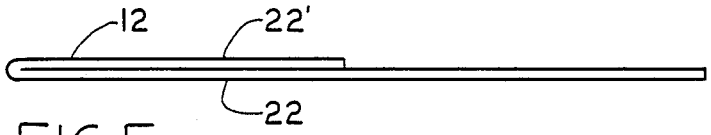
FIG. 5 is a side sectional view along the line 5—5 of FIG. 1.

FIG. 5 is a side sectional view along the line 5—5 of FIG. 1 showing how the second sides 22, 22' of the first and second sheets 20, 20' are welded together to form the cap portion 12.

Figure 6:
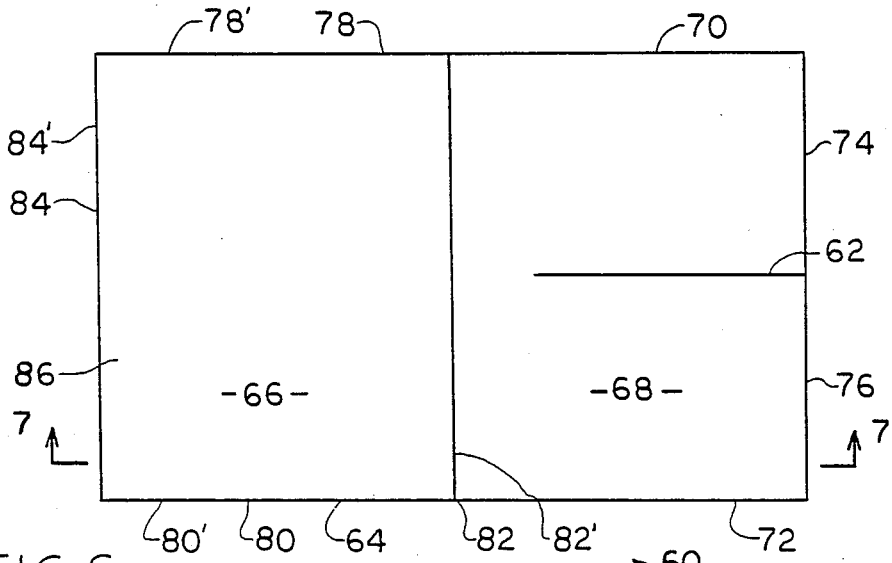
FIG. 6 is a top plan view of another embodiment of the invention having a slit cut.

FIG. 6 is a top plan view of another embodiment of the cap and cape, generally designated 60, having a slit cut 62 and fabricated from three separate sheets of flexible material 64, 66, and 68. The flexible sheet material between the cut 62 and the sides 70 and 72 is gathered together when the ties 74 and 76 are tied together as shown in FIG. 3. As in the previous embodiment, the first sides 78, 78' and second sides 80, 80' of the first and second sheets 64 and 66 are welded together. However in this embodiment unlike in the previous embodiment, the second ends 82, 82' of the first and second sheets are welded together instead of the first ends 84, 84' with the result that the open end of the cap portion 86 faces away from the ties 74 and 76.

FIG. 7 is a side sectional view along the line 7—7 of FIG. 6 showing the fabrication of the cap and cape 60 from the three separate sheets 64, 66, and 68 with the opening of the cap portion 86 at the first ends 84, 84' of these sheets. The first end 88 of the third sheet 68 is welded to the second ends 82, 82' of the first and second sheets 64 and 66 by the lamination of the three layers of material.

Figure 8:
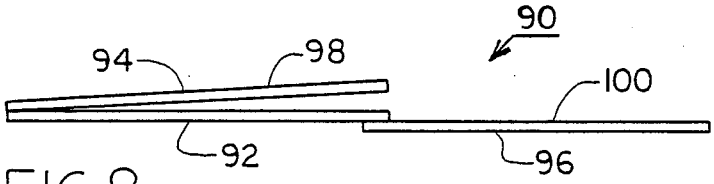
FIG. 8 is a side sectional view similar to FIG. 7 of another embodiment.

FIG. 8 is a side sectional view similar to FIG. 7 of another embodiment of the cap and cape, generally designated 90, showing fabrication from three separate sheets 92, 94, and 96 of flexible material with the opening of the cap portion 98 toward the tie 100 similar to FIG. 4.

In view of the above, it may be seen that several embodiments are provided of a disposable cap and cape for use during chemical treatments of hair. Of course, the structure may be variously implemented depending upon specific applications. Accordingly, the scope hereof shall not be referenced to the disclosed embodiments, but on the contrary, shall be determined in accordance with the claims as set forth below.

I claim:

1. A disposable cap and cape, comprising:
a first flexible sheet having first and second sides and first and second ends;
a second flexible sheet having first and second sides and first and second ends;
as third flexible sheet having first and second sides, first and second ends, and a cut between said sides extending from said second end toward said first end defining a first tie between said first side and said cut and a second tie between said cut and said second side;
said first sides of said first and second sheets coupled together;
said second sides of said first and second sheets coupled together;
said first ends of said first and second sheets coupled together; and
said first end of said third sheet coupled to said second end of said first sheet.

2. A disposable cap and cape in accordance with claim 1 wherein said first and second flexible sheets are fabricated from a single unitary sheet folded at said first ends of said first and second flexible sheets.

3. A disposable cap and cape in accordance with claim 1 wherein said first and third flexible sheets are fabricated from a single unitary sheet.

4. A disposable cap and cape in accordance with claim 1 wherein said first, second, and third flexible sheets are fabricated from a single unitary sheet folded at said first ends of said first and second flexible sheets.

5. A disposable cap and cape in accordance with claim 1 wherein said cut is substantially U-shaped forming a U-shaped neck opening between said first and second ties.

6. A disposable cap and cape, comprising:
a first flexible sheet having first and second sides and first and second ends;
a second flexible sheet having first and second sides and first and second ends;
a third flexible sheet having first and second sides, first and second ends, and a substantially U-shaped cut between said sides extending from said second end toward said first end defining a U-shaped neck opening and a first tie between said first side and said cut and a second tie between said cut and said second side;
said first sides of said first and second sheets coupled together;
said second sides of said first and second sheets coupled together;
said first ends of said first and second sheets coupled together;
said first end of said third sheet coupled to said second end of said first sheet; and
said first, second, and third flexible sheets fabricated from a single unitary sheet folded at said first ends of said first and second flexible sheets.

7. A disposable cap and cape, comprising:
a first flexible sheet having first and second sides and first and second ends;
a second flexible sheet having first and second sides and first and second ends;

a third flexible sheet having first and second sides, first and second ends, and a cut between said sides extending from said second end toward said first end defining a first tie between said first side and said cut and a second tie between said cut and said second side;

said first sides of said first and second sheets coupled together;

said second sides of said first and second sheets coupled together;

said second ends of said first and second sheets coupled together; and said first end of said third sheet coupled to said second end of said first sheet.

8. A disposable cap and cape in accordance with claim 7 wherein said first and second flexible sheets are fabricated from a single unitary sheet folded at said second ends of said first and second flexible sheets.

9. A disposable cap and cape in accordance with claim 7 wherein said first and third flexible sheets are fabricated from a single unitary sheet.

10. A disposable cap and cape in accordance with claim 7 wherein said cut is substantially U-shaped forming a U-shaped neck opening between said first and second ties.

11. A disposable cap and cape in accordance with claim 10 wherein said first and second flexible sheet are fabricated from a single unitary sheet folded at said second ends of said first and second flexible sheets.

12. A disposable cap and cape in accordance with claim 10 wherein said first and third flexible sheets are fabricated from a single unitary sheet.

* * * * *